US007780753B2

(12) United States Patent
Lang

(10) Patent No.: US 7,780,753 B2
(45) Date of Patent: Aug. 24, 2010

(54) DUST COLLECTOR CUP OF FALL CENTRIFUGAL SEPARATION TYPE

(76) Inventor: Weiguo Lang, No. 311 Chang Yuan Road, Yuyao, Zhejiang (CN) 315400

( * ) Notice: Subject to any disclaimer, the term of this patent is extended or adjusted under 35 U.S.C. 154(b) by 434 days.

(21) Appl. No.: 11/814,720

(22) PCT Filed: Jan. 4, 2006

(86) PCT No.: PCT/CN2006/000003

§ 371 (c)(1),
(2), (4) Date: Jul. 25, 2007

(87) PCT Pub. No.: WO2006/125354

PCT Pub. Date: Nov. 30, 2006

(65) Prior Publication Data

US 2008/0104795 A1 May 8, 2008

(30) Foreign Application Priority Data

May 27, 2005 (CN) ..... 2005 1 0049880
May 27, 2005 (CN) ..... 2005 1 0049881

(51) Int. Cl.
*B01D 50/00* (2006.01)

(52) U.S. Cl. ..... 55/337; 55/336; 55/343; 55/345; 55/346; 55/399; 55/426; 55/459.1; 55/DIG. 3; 15/352; 15/353

(58) Field of Classification Search ..... 55/337, 55/336, 343, 345, 346, 399, 426, 459.1, DIG. 3; 15/353, 352, 363
See application file for complete search history.

(56) References Cited

U.S. PATENT DOCUMENTS 5,078,761 A * 1/1992 Dyson ..... 96/400

(Continued)

FOREIGN PATENT DOCUMENTS

CN 2453827 10/2001

(Continued)

OTHER PUBLICATIONS

European Examination Report, dated Feb. 22, 2008, for related Application No./Patent No. 06705431.2-2316 PCT/CN2006000003, which includes Supplementary Search Report.

(Continued)

*Primary Examiner*—Jason M Greene
*Assistant Examiner*—Dung Bui
(74) *Attorney, Agent, or Firm*—Fox Rothschild LLP; Richard Woodbridge

(57) ABSTRACT

A dust collector cup working in the principle of fall centrifugal separation, consists of cup body (13), outlet (3) on the cup body (13), inlet (1) tangential to the circumferential wall of the cup body (13), and a separator settled in the cup body (13). The separator is composed of outlet tube (9), inlet (6) on the wall of the outlet tube (9), and the isolating shield (7) under the inlet (6) of the outlet tube (9), with the outlet tube (9) linked to the outlet (3) of the cup body (13). The fall between the horizontal positions of the lower end of inlet of the cup body (13) and the upper end of the inlet (6) of the outlet tube (9) is 0-140 mm.

12 Claims, 4 Drawing Sheets

U.S. PATENT DOCUMENTS

| | | | | |
|---|---|---|---|---|
| 5,145,499 | A * | 9/1992 | Dyson | 55/337 |
| 5,846,273 | A * | 12/1998 | Dyson | 55/337 |
| 6,171,356 | B1 * | 1/2001 | Twerdun | 55/337 |
| 6,425,931 | B1 * | 7/2002 | Croggon | 55/414 |
| 6,461,508 | B1 * | 10/2002 | Thomson | 210/512.1 |
| 6,546,593 | B2 * | 4/2003 | Oh et al. | 15/353 |
| 6,578,230 | B2 * | 6/2003 | Park et al. | 15/353 |
| 6,660,053 | B2 | 12/2003 | Oh et al. | |
| 6,679,930 | B1 | 1/2004 | An et al. | |
| 6,757,933 | B2 * | 7/2004 | Oh et al. | 15/353 |
| 6,859,975 | B2 | 3/2005 | Ohta et al. | |
| 6,902,596 | B2 * | 6/2005 | Conrad et al. | 55/459.1 |
| 7,105,034 | B2 * | 9/2006 | Jung et al. | 55/337 |
| 7,152,275 | B2 * | 12/2006 | Hitzelberger et al. | 15/352 |
| 7,222,392 | B2 * | 5/2007 | McCormick et al. | 15/353 |
| 7,331,084 | B2 * | 2/2008 | Oh | 15/353 |
| 7,361,200 | B2 * | 4/2008 | Oh et al. | 55/343 |
| 7,410,516 | B2 * | 8/2008 | Ivarsson et al. | 55/337 |
| 7,419,522 | B2 * | 9/2008 | Arnold | 55/345 |
| 7,488,362 | B2 * | 2/2009 | Jeong et al. | 55/337 |
| 7,556,662 | B2 * | 7/2009 | Lee et al. | 55/345 |
| 2002/0011050 | A1 | 1/2002 | Hansen | |
| 2002/0020154 | A1 * | 2/2002 | Yang | 55/337 |
| 2002/0178697 | A1 * | 12/2002 | Oh et al. | 55/337 |
| 2002/0178700 | A1 * | 12/2002 | Oh et al. | 55/337 |
| 2003/0014953 | A1 * | 1/2003 | Oh | 55/337 |
| 2003/0066273 | A1 * | 4/2003 | Choi et al. | 55/337 |
| 2003/0159411 | A1 * | 8/2003 | Hansen et al. | 55/337 |
| 2004/0020885 | A1 | 2/2004 | Newman | |
| 2004/0025287 | A1 * | 2/2004 | McCormick et al. | 15/353 |
| 2005/0125940 | A1 * | 6/2005 | McDowell | 15/353 |
| 2006/0090428 | A1 * | 5/2006 | Park et al. | 55/337 |

FOREIGN PATENT DOCUMENTS

| | | |
|---|---|---|
| CN | 1426734 | 7/2003 |
| CN | 1575845 | 2/2005 |
| WO | WO02069778 | 9/2002 |
| WO | WO03030702 | 4/2003 |
| WO | PCT/CN2006/000003 | 3/2006 |

OTHER PUBLICATIONS

European Examination Report, dated Jul. 23, 2008, Application No./Patent No. 06705431.2-2316.

* cited by examiner

DUST COLLECTOR CUP OF FALL CENTRIFUGAL SEPARATION TYPE

CROSS-REFERENCE TO RELATED APPLICATIONS

This is the U.S. National Stage of International Application No. PCT/CN06/000003, filed Jan. 4, 2006, which is based on and claims priority to Chinese Application Nos. 200510049880.2 and 200510049881.7, both filed May 27, 2005.

FIELD OF THE INVENTION

This invention relates to a dust collector cup working in the principle of fall centrifugal separation. More particularly, the present invention relates to a dust collector cup which utilizes the principle of fall difference to increase the centrifugal force that separates dust and air, so as to improve the separation effect.

DESCRIPTION OF THE PRIOR ART

Common centrifugal dust collectors utilizing vacuum principle send air with dust or foreign matters into the inlet of dust cup along tangential direction and generate a centrifugal vortex flow in the dust cup, so that comparatively large and heavy particles or filth will deposit at the bottom of the dust cup, which will be cleaned up. In order to generate comparatively great vortex flow in the dust cup, a centrifuge with an inlet is usually installed in the center of the dust cup. The inlet of the centrifuge usually corresponds to that of the dust cup; therefore, the centrifugal force generated in the dust cup is not great enough. For example, C.N. Pat. No. 01144390.1, named "The dust collecting box of vacuum dust collector", works not well enough in dust separation. As a result, the fine dusts easily go out from the outlet of the dust-collecting box via the inlet of the centrifuge directly. In that case, the filter piece installed on the outlet of dust collecting box will be plugged up by the fine dusts, so as to increase dust collecting resistance of the motor. What's more, the motor will be burnt under serious condition; the operation performance of the dust collector will be affected under less serious condition.

In order to improve the effect of air-dust separation, some centrifugal dust cups are designed with two separation stages, such as the utility model NO. ZL00266255.8 named "Split spiral wind dust filtration device of dust collector". However, the two-stage separation units of this product are combined in parallel style in the dust cup and connected with each other via a ventilating duct. Therefore, it is obvious that there are defects and insufficiency of too great volume, increased material cost and being not suitable for vertical type or portable type dust collector.

Therefore, a kind of dust collector cup, which is small in volume, compact in structure and highly efficient in terms of separation, is greatly expected. So that the defects and insufficiency of being great in volume, weight and raw material consumption existing in current technology could be overcome, and the application requirements of various dust collector could be satisfied.

SUMMARY OF THE INVENTION

The object of this invention is to provide a dust collector cup working in the principle of fall centrifugal separation to solve the technical problems of existing dust collector cups such as poor separation effect, great in volume and weight, unable to meet the development and manufacture requirements of vertical type or portable type dust collector products, great raw material consumption and high cost.

In order to achieve the above-mentioned objects, the technical solution of this invention is as follows:

This invention discloses a dust collector cup working in the principle of fall centrifugal separation. The cup consists of cup body, outlet on the cup body, inlet tangential to the circumferential wall of the cup body, and a separator settled in the cup body. The separator is composed of outlet tube, inlet on the wall of the outlet tube, and the isolating shield under the inlet of the outlet tube, with the outlet tube linked to the outlet of the cup body. The fall between the horizontal positions of the lower end of inlet of the cup body and the upper end of the inlet of the outlet tube is 0-140 mm.

Since there is a certain fall difference between the inlet of cup body and that of the outlet tube, certain air pressure difference exists in the two inlets. Air with dust, after entering the dust cup, will generate a swift downward spiral wind, and the dust will be thrown towards the circumferential wall under centrifugal force and gravity, and falling to the bottom of the dust-collecting cavity of the cup body. Due to the separation effect of the isolating shield, dust falling into the cavity is hard to be thrown up and goes into the inlet of separator under the effect of the upper spiral wind. Only small amount of fine dust particles will be released from the outlet of the outlet tube with air flow, and settle on the filter piece. Thus, the effect of dust separation will be improved to a great extent. The dust collector cup of this invention features simple structure, low cost and small volume.

Preferably, the fall between the horizontal positions of the lower end of inlet of the cup body and the upper end of the inlet of the outlet tube is 30-140 mm.

An inner tube can be coaxially installed in said outlet tube, the height of which should be lower than that of the outlet tube. The inlet of the separator is connected with the outlet of the dust cup via the inner tube to constitute a split two-stage separation dust collector cup. The dust removal device, which is used to separate dust and air, adopts the pattern of inner tube coaxially laid out with outlet tube, so that the contour volume of the product is reduced. The inlet of the separator is used both as the outlet of clean air and the inlet of the inner dust cavity at the same time, getting rid of the transverse connecting duct in current technologies, facilitating to reduce air pressure loss. Compared with current technologies, this invention possesses a dust collector cup with two-stage separation function, which is more compact in structure, so that the contour volume and the raw material consumption can be greatly reduced. And it is especially suitable for the development and manufacture of vertical or portable dust collector products.

Furthermore, the described inlet of the separator is an annular structure consisting of vanes smoothly arranged in an annular and spiral array. Vanes arranged in a spiral manner are configured for the inlet of the separator, so that spiral wind will be generated in the inner tube and the inner dust cavity. The cleaning effect of the separated dust is further improved.

There could be one extension tube connected with the bottom of the described inner tube. And a cylindrical cavity could be downward extended from the lower part of the well arranged vane inner ring at the inlet, through isolating shield, which is connected with the described extension tube. A dust collector cup of three-stage separation is thus constituted. After one stage separation, most of dust is separated and the air with small amount of fine dust enters the gap between the extension tube and the cylindrical cavity via the annular inlet of the separator. Guided by the vanes spirally arranged at the inlet, the air with small amount of fine dust entering the gap generates a vortex air flow too. When that part of air declines to the lower end of the extension tube, because of the effect of centrifugal force, the fine dust entering the gap swirls downward and enters into the cylindrical cavity while the separated air flows upward to the inner tube via the extension tube.

Moreover, one spiral structure rotating up and down is configured in the extension tube and after the second-stage separation, because of the effect of the spiral structure in the extension tube, the separated air continues to swirl upward. If that part of air still carries a slight amount of fine dust, and when the air rises to the upper part of the extension tube, the swirl radius suddenly increases and the air pressure declines. So the centrifugal force once again separates and throws the extremely small amount of fine dust from the air onto the inner wall of the outlet tube, which will swirl along the wall and fall down. The separation effect can be further improved.

DETAILED DESCRIPTION OF THE PREFERRED EMBODIMENTS

Hereinafter, the preferred embodiments of the present invention will be described with reference to FIG. 1 to FIG. 8 so that the invention may be better and more fully understood.

Figure 1:
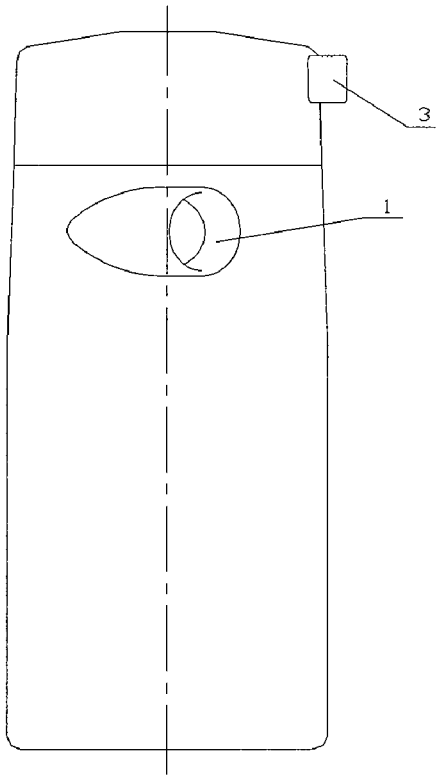
FIG. 1 is a view illustrating a contour structure of the dust collector cup of fall centrifugal separation type of this invention

FIG. 1 is a view illustrating a contour structure of the dust collector cup of fall centrifugal separation type of this invention and it shows the shapes of inlet 1 and outlet 3 of the dust collector cup of fall and centrifugal type.

Figure 2:
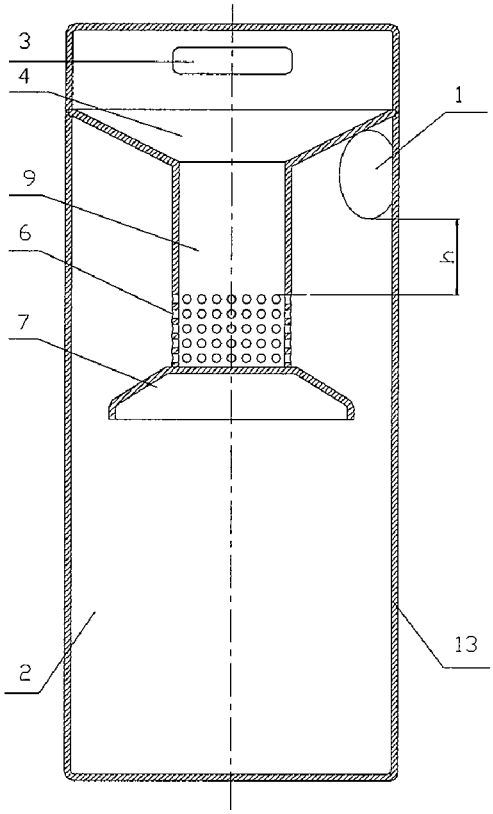
FIG. 2 is a view illustrating the basic structure of the dust collector cup of fall centrifugal separation type of this invention

FIG. 2 shows an embodiment of this invention. As shown in FIG. 2, the dust collector cup of fall and centrifugal type consists of cup body 13, inlet 1 configured along tangential direction on circumferential wall of the cup body 13, a cup cover on top of the cup body 13 and outlet 3 of purified air on the cup cover. A separator is installed in the cup body 13 and the separator consists of outlet tube 9, inlet 6 on the tube wall of the outlet tube 9 and isolating shield 7 installed below the inlet 6 on the wall of the outlet tube 9. Inlet 6 is composed of grid holes. The outlet of the outlet tube 9 is in shape of a horn-type and the outlet external edge of the horn-type is placed on the upper opening of the cup body 13 to make it connected with the cup body 13. There is a certain fall h between the lower end of inlet 1 of cup body 13 and the upper end of inlet 6 of outlet tube 9, and the fall h can be 0-140 mm. A filter piece can be installed between the outlet 3 in the cup cover of cup body 13 and the outlet of outlet tube 9 (not shown in the figure), which can also be installed between the outlet 3 in the cup cover of cup body 13 and the inlet of the electric blower. The shape of the isolating shield 7 installed on the outlet tube 9 is frustum of a cone and the opening of the isolating shield 7 is pointed to the dust-collecting cavity 2 in the lower part of the cup body 13.

Figure 3:
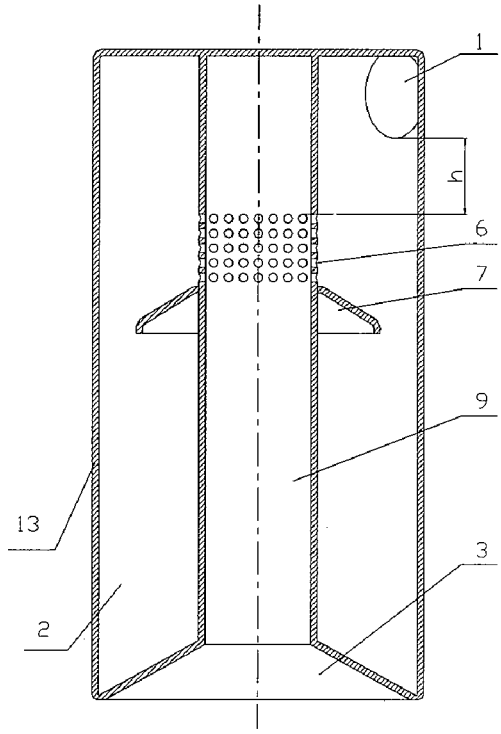
FIG. 3 is a view illustrating another basic structure of the dust collector cup of fall centrifugal separation type of this invention

FIG. 3 shows another implementation example of this invention. As shown in the figure, in the dust collector cup of fall and centrifugal type, the outlet 3 of the cup body 13 and the outlet of the outlet tube 9 are configured at the bottom; the top of the outlet tube 9 of the separator in the cup body 13 is directly fixed on the top of the cup body 13. The outlet tube 9 below the isolating shield 7 extends downwardly and is connected with the bottom of the cup body 13 to form a horn-type outlet 3; meanwhile, the inner wall of the cup body 13 and the upper part of outlet 3 form the dust-collecting cavity 2 of the cup body 13. A filter piece is installed outside of the outlet of the cup body 13. Other structures are the same as those in the embodiment in FIG. 2.

When the dust collector is in operation, a negative pressure is generated in the dust cup because of the electric blower and the air with dust and filth enters the inlet 1 configured in the dust cup along tangential direction. As there is a certain fall height between the inlet 6 in the outlet tube 9 of the separator and the inlet 1 of the dust cup, a certain air pressure difference is generated between the two inlets; therefore, there is a certain air pressure difference between the two inlets. Air with dust, after entering the dust cup, will generate a swift downward spiral wind, and the dust will be thrown towards the circumferential wall under centrifugal force and gravity, and falling to the bottom of the dust-collecting cavity of the cup body. Because of the separating effect of the isolating shield 7, the dust having fallen into the dust-collecting cavity are very difficult to be raised once again and enter into the inlet 6 of the separator by the effect of the above spiral wind. The separated and purified air enters the inlet 6 of the outlet tube 9 of the separator, passes through the horn-type outlet of the outlet tube (that is the outlet 3 of the dust cup) and the filter piece, then enters into the electric blower, and at last the air is discharged from the dust collector.

Figure 4:
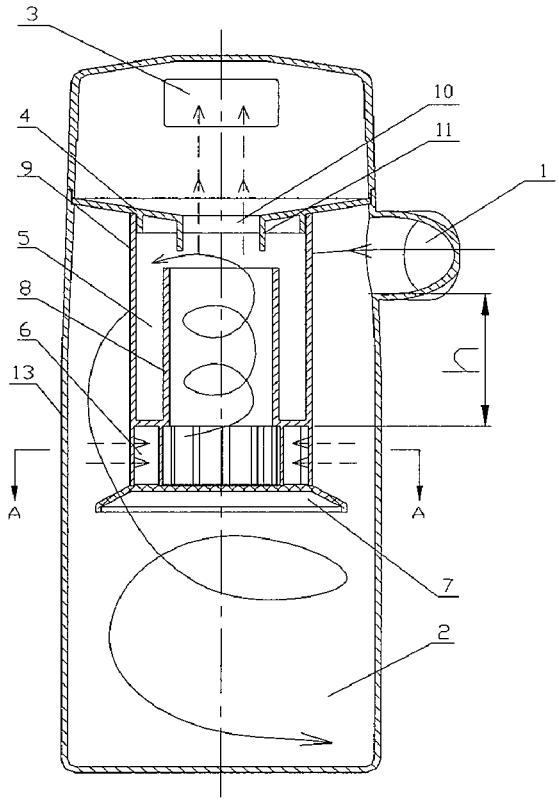
FIG. 4 is a sectional view from left side of the dust collector cup of fall and centrifugal two-stage separation type in FIG. 1.
Figure 5:
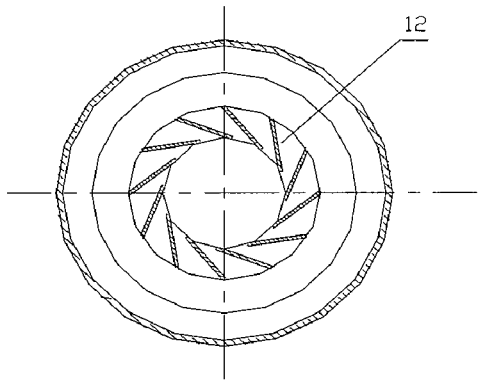
FIG. 5 is a sectional view taken along a line A-A in FIG. 4.

FIG. 4 and FIG. 5 show the third embodiment of this invention. As shown in FIG. 4, the dust cup includes dust cup body 13, the dust cup inlet 1 tangential to the wall of the dust cup body 13, the dust cup outlet 3 in the cover of the cup body and the separator installed in the cup. There is an inlet 6 on the separator and an isolating shield 7 installed below the inlet 6. The inlet 6 of the separator is connected with the dust cup inlet 1. The upper part of the inlet of the described separator is connected with inner tube 8 and outlet tube 9 which are coaxially settled and the lower part is connected with a isolating shield 7 which is frustum of a cone. The external wall of the inner tube 8 is connected and sealed with the bottom of the internal wall of the outlet tube 9, where the inner tube 8 is connected with outlet 3 of dust cup, and the inner tube 8 is shorter than the outlet tube 9. There is a connecting support 4 in the dust cup, which is connected to the upper end of the outlet tube 9 of the separator in a plug-in mode and then placed on the mouth of the dust cup. The connecting support 4 presents a horn-type shape with a large upper opening and a small lower opening and there is a central hole 10 in the support 4 and the lower part of the central hole is connected with a short tube 11 corresponding to the inner tube 8. As shown in FIG. 5, the inlet 6 of the separator is an annular body, which consists of a group of vanes 12 smoothly arranged in a spiral annular array. One end of the vanes 12 is connected to the sealed and connected end of the bottom of the inner tube and outlet tube, and the other end is fixed on the isolating shield 7. In order to ensure the dust and air separation effect and make the air with dust be able to quickly generate sufficient fast downward spiral wind after entering the dust cup, and facilitate dust separation deposition, a certain fall is settled between the horizontal positions of the upper end of the inlet 6 of the separator and the lower end of the dust cup inlet 1. It is ideal to control the fall range h within 0-140 mm.

The operation principle of the third embodiment of this invention is further described below with FIG. 4 and FIG. 5. Connect the air duct in the dust collector connecting the electric blower with the dust cup outlet 3. Turn on the switch and after the electric blower begins to operate, a negative pressure is generated in the inner cavity of the dust cup. The air with dust enters into the inner cavity of the dust cup from inlet 1 of the dust cup. As the axial line of inlet 1 of the dust cup is tangential to the circumference surface of the dust cup body, spiral air flow is generated. As the position of inlet 6 of the separator is lower than that of inlet 1 of the dust cup, after the air with dust enters the dust cup, a swift downward spiral wind is generated. The dusts are thrown onto the internal wall and fall down to the dust-collecting cavity 2 at the bottom of the dust cup 13 under centrifugal force. Because of the separating effect of the isolating shield 7, the dust having fallen into the dust-collecting cavity 2 are very difficult to be raised once again and enter into the inlet 6 of the separator by the effect of the above spiral wind. Most of the separated dust and the air with a slight amount of dust enter into the outlet tube 9 via the annular inlet 6 of the separator. Guided by the spirally rowed up vanes 12 smoothly distributed at the inlet, the air with slight amount of dust in the outlet tube 9 also generates a swirling air flow. Because the inner tube 8 is shorter than the outlet tube 9, when that part of air rises to the upper end of the inner tube 8, the swirling radius suddenly increases, the air pressure declines and the centrifugal force will once again separate the small amount of fine dust mixed in the air. The separated dust will be thrown onto the inner wall of the outlet tube 9 and fall into the inner dust cavity 5. After two-stage separation, the air is guided by the short tube 11 of support 4, enters into the electric blower via the dust cup outlet 3 and then discharged from the dust collector.

Figure 6:
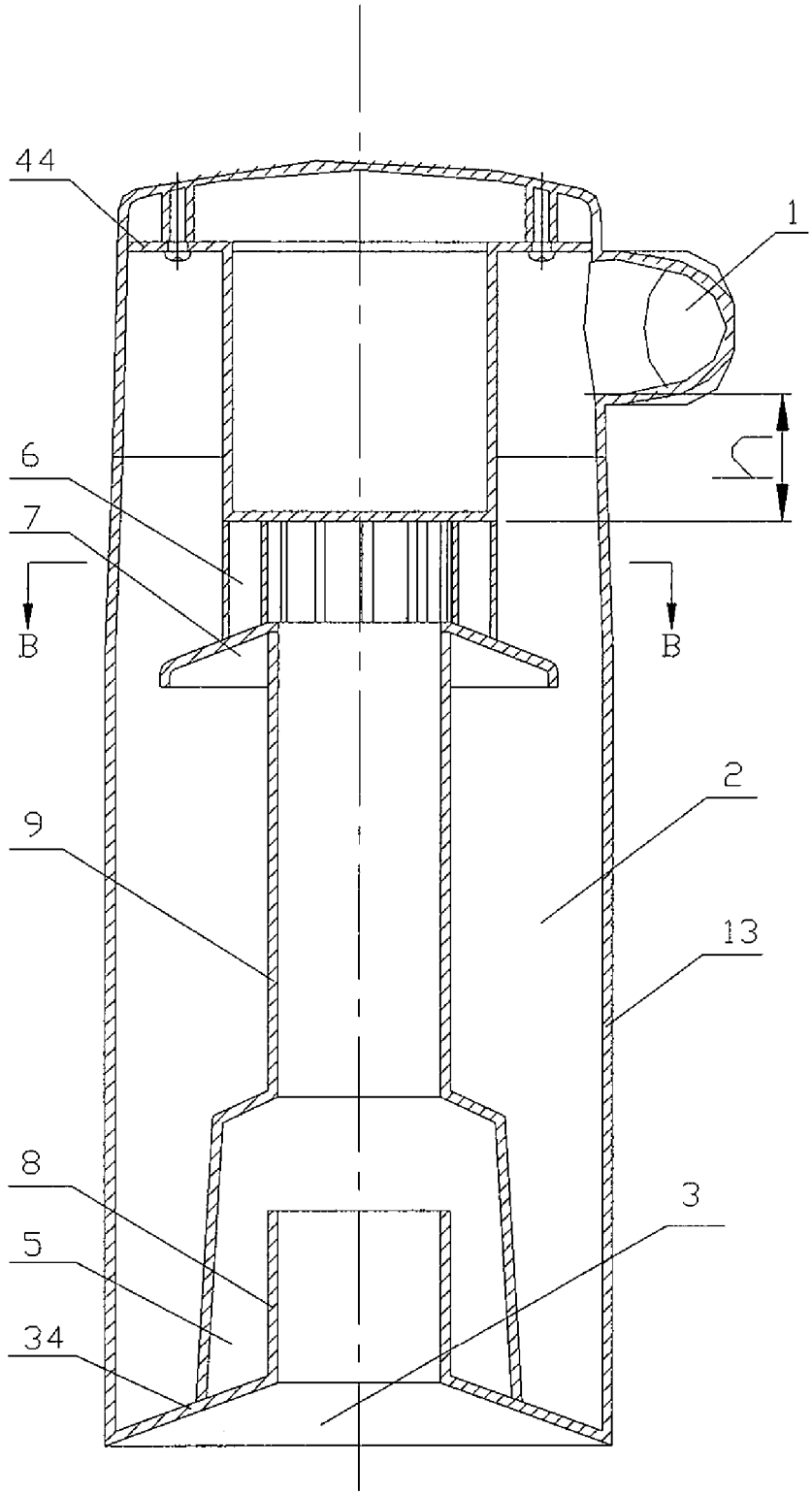
FIG. 6 is sectional view of another dust collector cup of fall centrifugal separation type of this invention.

FIG. 6 shows the fourth embodiment of the invented product. The dust cup outlet 3 of this embodiment is configured at the bottom and consists of the horn-type flange 34 connecting between the bottom of the inner tube 8 and the dust cup body 13. The upper part of the inlet 6 of the described separator is fixed and connected to the top of the dust cup via the connecting support 44, and the lower part is connected with a isolating shield 7 which is frustum of a cone with a central hole and connected with the upper end of the outlet tube 9. The outlet tube (air outlet tube) 9 extends downward from the lower end of the inlet 6 of the separator and connected to the horn-type flange 34. The bottom of the outlet tube 9 can also be expanded to make the diameter of that part of outlet tube 9 corresponding to the inner tube 8 larger than that of the outlet tube 9 connected at the bottom of the inlet 6 of the separator. The rest parts of the structure are the same as that in the third embodiment, which will not be described repeatedly here.

The operation principle is further described with FIG. 6 below. Connect the air duct connecting the inlet of the electric blower in the dust collector with the dust cup outlet 3. Turn on the switch and after the motor begins to operate, a negative pressure is generated in the inner cavity of the dust cup. The air with dust enters into the inner cavity of the dust cup via the dust cup inlet 1. As the axial line of the dust cup inlet 1 is tangential to the circumference surface of the dust cup body 13, a swirling air flow is generated. Because the position of the inlet 6 of the separator is lower than the inlet 1 of the dust cup, after the air with dust enters into the dust cup, a swift downward spiral wind is generated. Dust, under the centrifugal force, is thrown onto the inner wall and fall down into the dust-collecting cavity 2 between the dust cup body and the outlet tube. Because of the separating effect of the isolating shield 7, the dust having fallen into the dust-collecting cavity 2 is very difficult to be raised once again and to enter into the inlet 6 of the separator by the effect of the above spiral wind. Most of the dust is separated and the air with a slight amount of fine dust enters into the outlet tube 9 via the annular inlet 6 of the separator. Guided by the spirally rowed up vanes 12 smoothly distributed at the inlet (refer to FIG. 5), the air with slight amount of fine dust in the outlet tube 9 also generates a spiral movement. When this part of air declines close to the upper end of the inner tube 8, as the diameter of the outlet tube 9 increases, the air spiral movement radius suddenly increases accordingly and the air pressure decreases so the centrifugal force once again separates the slight amount of fine dust mixed in the air and throw the dust onto the sealed and connected end between the inner wall of the outlet tube 9 and the external wall of the inner tube 8 and the dust will fall down into the inner dust cavity 5. The air after two-stage separation enters the electric blower via the inner tube 8 and the dust cup outlet at the bottom and then is discharged from the dust collector.

Figure 7:
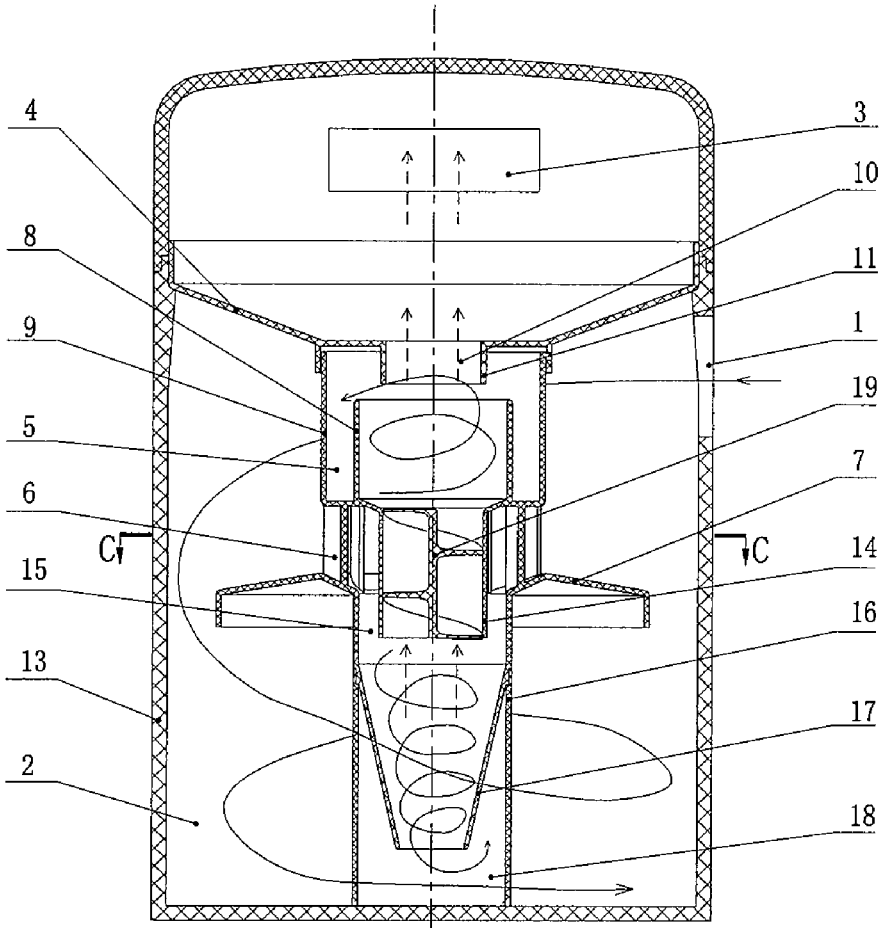
FIG. 7 is a sectional view of the dust collector cup of fall and centrifugal three-stage separation type of this invention.

As shown in FIG. 7, on the basis of the dust collector cup of fall and two-stage separation type in the above-described third embodiment, the inner tube 8 of the separator can extend downward and pass through the isolating shield 7. There is a gap reserved between the external wall of the extension tube 14 and the inner ring of the vanes 12 spirally and smoothly arranged at the inlet 6 of the separator (refer to FIG. 8), which is favorable for the unimpeded air flow entering the vanes 12. The lower end of the inner ring of the vanes 12 spirally and smoothly arranged at the inlet 6 passes through the isolating shield 7 and extends downward to form a cylindrical cavity 16 with an inside diameter consistent with that of the inner ring of the vanes 12 smoothly distributed at the inlet 6 of the separator; therefore, there is a gap reserved between the cylindrical cavity and the extension tube 14 is consistent with that between cylindrical cavity and inner ring of vanes 12. The two gaps are connected with each other. In the cylindrical cavity 16, a conical cylinder 17 with an opening at the bottom is configured. The upper end of the conical cylinder 17 is connected to the cylindrical cavity 16 at the horizontal position lower than the lower end of the extension tube 14. There is a gap between the lower end of the conical cylinder 17 and the bottom of the cylindrical cavity 16. A spiral structure 19 rotating up and down is configured in the described extension tube 14.

Figure 8:
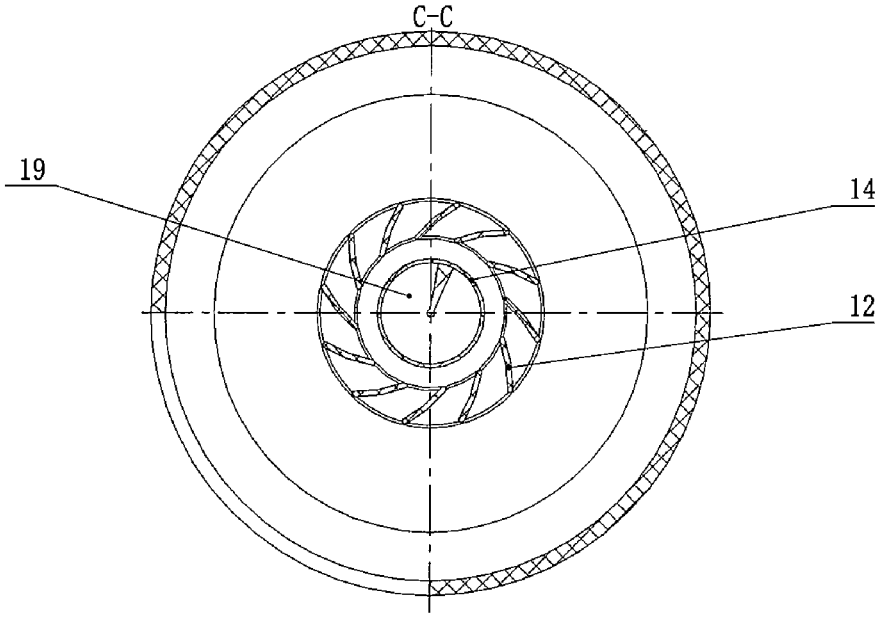
FIG. 8 is a sectional view taken along a line C-C in FIG. 7.

The operation principle of the three-stage separation of this invention is described with FIG. 7 and FIG. 8 below. Connect the air duct connecting the inlet of the electric blower in dust collector with the outlet of the dust cup, and turn on the switch After the electric blower begins to operate, a negative pressure is generated in the inner cavity of the dust cup. The air with dust enters into the inner cavity of the dust cup via inlet 1 of the dust cup. As the axial line of inlet 1 of the dust cup is tangential to the circumference surface of dust cup shell 13, a swirling air flow is generated. Because of the position of inlet 6 of the separator is lower than that of the inlet of the dust cup, there is a certain fall in between, which makes a certain air pressure difference generated between the two inlets. After the air with dust enters into the dust cup, a swift downward spiral wind is generated. The dust, under the centrifugal force, is thrown onto the circumference wall, swirling along the wall and falling into the dust-collecting cavity 2 between the dust cup body 13 and the outlet tube 9. Because of the separating effect of the isolating shield 7, the dust having fallen into the dust-collecting cavity 2 is very difficult to be raised once again and to enter into the inlet 6 of the separator by the effect of the above spiral wind. Most of the dust is separated and the air with only a slight amount of fine dust enters the gap 15 between the extension tube 14 and the cylindrical cavity 16 via the annular inlet 6 of the separator. Guided by the spirally rowed up vanes 12 smoothly arranged at the inlet, the air with slight amount of fine dust entering the gap 15, generates spiral air flow in the same way. When that part of air declines to the lower end of the extension tube, because of the effect of the centrifugal force, the fine dust having entered the gap swirl downward in the tangential direction along the inner wall of the cone 17 and enters the inner cavity 18 of the cylindrical cavity 16; meanwhile, the separated air swirls upward into the inner tube 8 via the extension tube 14. Because of the function of the helicoid 19 in the extension tube 14, the separated air continues to swirl upward. And if that part of air still carries a slight amount of fine dust, when that part of air rises to the upper end of the inner tube 8, the spiral radius suddenly increases and the air pressure declines, the centrifugal force will once again separate the extremely slight amount of fine dust mixed in the air and throw it onto the inner wall of the outlet tube 9. And the dust will swirl along the wall and fall down into the inner dust cavity 5. After three-stage separation, the air will be guided by the short tube 11 on the support 4, enters the electric blower via the outlet 3 of the dust cup and then is discharged from the dust collector.

Detailed descriptions of the product structures of this invention are provided above and in order to more objectively prove the dust aspiration effect of the product of this invention, the multi structures of the two-stage separation products of this invention are taken as samples and dust aspiration effect tests are conducted.

Example 1

Horizontal dust collector with a depth from the lower end of the dust cup inlet to the bottom of the cup is 130 mm. The fall height h between the horizontal positions of the lower end of the dust cup inlet and the upper end of the inlet of the separator is supposed to be 30 mm.

Example 2

Vertical dust collector with a depth from the lower end of the dust cup inlet to the bottom of the cup is 270 mm. The fall height h between the horizontal positions of the lower end of the dust cup inlet and the upper end of the inlet of the separator is supposed to be 140 mm.

Example 3

Vertical dust collector with a depth from the lower end of the dust cup inlet to the bottom of the cup is 185 mm. The fall height h between the horizontal positions of the lower end of the dust cup inlet and the upper end of the inlet of the separator is supposed to be 45 mm (a datum between 30-140 with very good effect is given).

Example 4

Horizontal dust collector with a depth from the lower end of the dust cup inlet to the bottom of the cup is 170 mm. The fall height h between the horizontal positions of the lower end of the dust cup inlet and the upper end of the inlet of the separator is supposed to be 50 mm (a datum between 30-140 with very good effect is given).

Example 5

The height of the dust cup of a vertical dust collector is 185 mm. The fall height h between the horizontal positions of the lower end of the dust cup inlet and the upper end of the inlet of the separator is supposed to be 15 mm.

Example 6

The height of the dust cup of a vertical dust collector is 270 mm. The fall height h between the horizontal positions of the lower end of the dust cup inlet and the upper end of the inlet of the separator is supposed to be 90 mm.

The separation effect rest table is as follows:

TABLE 1

| Mixture | Weight before dust collection (g) | Weight of the dust collected in dust-collecting cavity after dust collection (g) | Separation effect (%) |
|---|---|---|---|
| Example 1 | 200 | 195 | 97.5 |
| Example 2 | 200 | 198 | 99.0 |
| Example 3 | 200 | 199.8 | 99.9 |
| Example 4 | 200 | 199.6 | 99.8 |
| Example 5 | 200 | 196.6 | 98.3 |
| Example 6 | 200 | 199.1 | 99.5 |

The mixture in the table is potato starch 80 g, bread bits 80 g, rice 30 g and hair 10 g.

The test result is the average value of ten operations with various dusts.

TABLE 2

| Potato starch | Weight before dust collection (g) | Weight of the dust collected in dust-collecting cavity after dust collection (g) | Separation effect (%) |
|---|---|---|---|
| Example 1 | 200 | 192.3 | 96.2 |
| Example 2 | 200 | 196.6 | 98.3 |
| Example 3 | 200 | 199.2 | 99.6 |
| Example 4 | 200 | 199.1 | 99.5 |
| Example 5 | 200 | 194.2 | 97.1 |
| Example 6 | 200 | 198.0 | 99.0 |

The dust aspiration and separation effect of the dust collector cup of the one-stage separation structure of this invention is also close to the data of above tests, while the dust aspiration and separation effect of the dust collector cup of three-stage separation structure is better than that of two-stage separation.

While the preferred embodiment of the invention has been described above, it will be recognized and understood that various modifications may be made therein and the appended claims are intended to cover all such modifications that may fall within the spirit and scope of the invention.

The invention claimed is:

1. A dust collector cup of fall centrifugal separation type, including a cup body, an outlet configured on the cup body, an inlet tangential to the circumferential wall of cup body, and a separator installed in cup body, said separator consisting of outlet tube, inlet configured in the wall of the outlet tube and the isolating shield installed below the inlet of the outlet tube, said outlet tube connecting with the outlet of the cup body, wherein the fall height between the horizontal position of the lower and inlet on the cup body and that of the upper end of the inlet of the outlet tube is 30-140 mm, wherein the height of an inner tube coaxially installed in said outlet tube is lower than that of the outlet tube, the bottom of the inner tube is connected to the outlet tube, the bottom of the inner tube is connected to the outlet tube and the inlet of the separator is connected with the outlet of the dust cup via inner tube, the inlet of said separator is an annular body consisting of vanes arranged spirally and smoothly based on an annular array.

2. The dust collector cup as claimed in claim 1, wherein the inlet consists of grid holes.

3. The dust collector cup as claimed in claim 1, wherein the height of an inner tube coaxially installed in said outlet tube is lower than that of the outlet tube, and the inlet of the separator is connected with the outlet of the dust cup via inner tube.

4. The dust collector cup as claimed in claim 1, wherein said outlet is configured at the bottom of the cup body, consisting of the horn-type flange connected between the bottom of the inner tube and the dust cup body; the top of the inlet of said separator is connected with the connecting support and fixed on top of the dust cup; the bottom of the separator inlet is fixed on the isolating shield with a central hole; said outlet tube is configured below the inlet of the separator, extends downward and connects with the horn-type flange.

5. The dust collector cup as claimed in claim 4, wherein the lower end of said connecting support is cylindrical and connected with the top of the separator inlet; the top end of the connecting support is flat and fixed on the top of the cup body.

6. The dust collector cup as claimed in claim 1, wherein said outlet tube is connected with the dust cup body via a connecting support with a central hole.

7. The dust collector cup as claimed in claim 6, wherein said connecting support is in a horn-type shape and a short tube corresponding to the inner tube is connected below the central hole.

8. The dust collector cup as claimed in claim 7, wherein an extension tube is connected at the bottom of said inner tube, the lower end of the inner ring of the vanes smoothly arranged at the inlet extends downward through the isolating shield to form a cylindrical cavity, which is connected with said extension tube.

9. The dust collector cup as claimed in claim 8, wherein said extension tube, a spiral structure rotating up and down is settled.

10. The dust collector cup as claimed in claim 9, wherein a conical cylinder with an opening at the bottom is configured in the cylindrical cavity, the upper end of the conical cylinder is connected with the cylindrical cavity, the upper end of the conical cylinder is connected with the cylindrical cavity at a horizontal position lower than the lower end of the extension tube, and there is a certain gap between the lower end of the conical cylinder and the bottom of the cylindrical cavity.

11. The dust collector cup as claimed in claim 10, wherein there is a first gap between the external wall of the extension tube and the inner ring of the vanes smoothly arranged at the inlet of the separator.

12. The dust collector cup as claimed in claim 11, wherein there is a second gap reserved between the cylindrical cavity and the extension tube. The second gap is connected with the first gap.

* * * * *